US009379492B2

(12) United States Patent
Zebhauser et al.

(10) Patent No.: US 9,379,492 B2
(45) Date of Patent: Jun. 28, 2016

(54) INSERTION TYPE CONNECTOR

(71) Applicant: ROSENBERGER HOCHFREQUENZTECHNIK GMBH & CO. KG, Fridolfing (DE)

(72) Inventors: Martin Zebhauser, Laufen (DE); Thomas Müller, Berchtesgaden (DE); Christian Schmidt, Wernberg-Köblitz (DE); Till Bredback, Traunstein (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/405,102

(22) PCT Filed: Jul. 10, 2013

(86) PCT No.: PCT/EP2013/002040

§ 371 (c)(1),
(2) Date: Dec. 2, 2014

(87) PCT Pub. No.: WO2014/023386

PCT Pub. Date: Feb. 13, 2014

(65) Prior Publication Data

US 2015/0132994 A1 May 14, 2015

(30) Foreign Application Priority Data

Aug. 7, 2012 (DE) ..... 20 2012 007 577 U

(51) Int. Cl.

| | |
|---|---|
| ***H01R 13/648*** | (2006.01) |
| ***H01R 13/6585*** | (2011.01) |
| ***H01R 12/72*** | (2011.01) |
| ***H01R 13/6461*** | (2011.01) |
| *H01R 9/03* | (2006.01) |

(52) U.S. Cl.

CPC ..... *H01R 13/6585* (2013.01); *H01R 12/724* (2013.01); *H01R 13/6461* (2013.01); *H01R 9/035* (2013.01)

(58) Field of Classification Search

CPC ..... H01R 13/6585
USPC ..... 439/607.09, 607.1, 607.11, 607.12, 439/578, 101, 607.08
See application file for complete search history.

(56) References Cited

U.S. PATENT DOCUMENTS

| | | | | |
|---|---|---|---|---|
| 6,077,122 A * | 6/2000 | Elkhatib | ..... | H01R 13/5804 439/417 |
| 6,380,485 B1 * | 4/2002 | Beaman | ..... | H01R 9/035 174/88 R |
| 6,843,657 B2 * | 1/2005 | Driscoll | ..... | H01R 23/688 439/289 |

(Continued)

FOREIGN PATENT DOCUMENTS

| | | |
|---|---|---|
| EP | 1263088 A1 | 12/2002 |
| GB | 2027290 A | 2/1980 |

*Primary Examiner* — Phuong Dinh
(74) *Attorney, Agent, or Firm* — DeLio, Peterson & Curcio, LL; Robert Curcio

(57) ABSTRACT

A connector having a housing and a plurality of contact element pairs fixed inside the housing, wherein at least two contact element pairs are arranged adjacent to each other in one row and at least one contact element pair is spaced from the row at identical spacings from the at least two contact element pairs in the row, and wherein a shielding element is arranged between the contact element pairs of the row and the further contact element pair.

2 Claims, 4 Drawing Sheets

(56) References Cited

U.S. PATENT DOCUMENTS

| | | | | |
|---|---|---|---|---|
| 7,195,518 | B2 * | 3/2007 | Bert | H01R 4/2441 439/290 |
| 7,462,071 | B1 | 12/2008 | Wu | |
| 2004/0224564 | A1 | 11/2004 | Wan | |
| 2010/0267261 | A1 | 10/2010 | Lin | |
| 2011/0104915 | A1 | 5/2011 | Lin | |
| 2011/0207342 | A1 | 8/2011 | Davis | |

* cited by examiner

INSERTION TYPE CONNECTOR

BACKGROUND OF THE INVENTION

1. Field of the Invention

The invention relates to a multiple insertion-type connector having a housing and a plurality of pairs of contact elements fixed in the housing which are designed to make contact with complementary pairs of contact elements of an mating insertion-type connector. More specifically, the invention relates to a multiple insertion-type connector suitable for the transmission of radio-frequency signals (RF signals).

2. Description of Related Art

A problem which is posed by multiple insertion-type connectors of this kind is to prevent crosstalk between the plurality of pairs of contact elements and the interference with signal transmission which goes hands in hand with this. For this purpose, it is known for shielding to be incorporated in the housing of the insertion-type connector, with provision being made for the entire circumference of each pair of contact elements to be surrounded by the shielding to enable a good shielding effect to be achieved. However, designing a multiple insertion-type connector in this way results in relatively high production costs.

SUMMARY OF THE INVENTION

Bearing in mind the problems and deficiencies of the prior art, it is therefore an object of the present invention to provide a multiple insertion-type connector which, while its transmission characteristics for RF signals remained good, could be produced particularly inexpensively.

The object of the present invention is directed to an insertion-type connector including a housing and a plurality of pairs of contact elements fixed in the housing which, in the plugged-together state, make contact with the contact elements of a further insertion-type connector, wherein at least two pairs of the plurality of pairs of contact elements are arranged in adjacent positions in a row and at least one further pair of contact elements is arranged to be spaced from the row, the further pair of contact elements being at identical spacings from the two pairs of contact elements which are the most closely adjacent pairs of contact elements, a shielding element being arranged between the two pairs of contact elements in the row on the one hand and the further pair of contact elements on the other hand.

The contact elements of all the plurality of pairs of contact elements are preferably connected to respective single conductors, the conductors there being laid out, in the same layout as the plurality of pairs of contact elements, at least two conductors in adjacent positions in a row, and at least one further conductor spaced from the row at identical spacings from the two conductors in the row.

The conductors preferably follow an angled path in the housing, and a shielding element is included, arranged between those portions of the two conductors in the row which are angled relative to the plurality of contact elements and the angled portion of the further conductor being spaced from the row.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
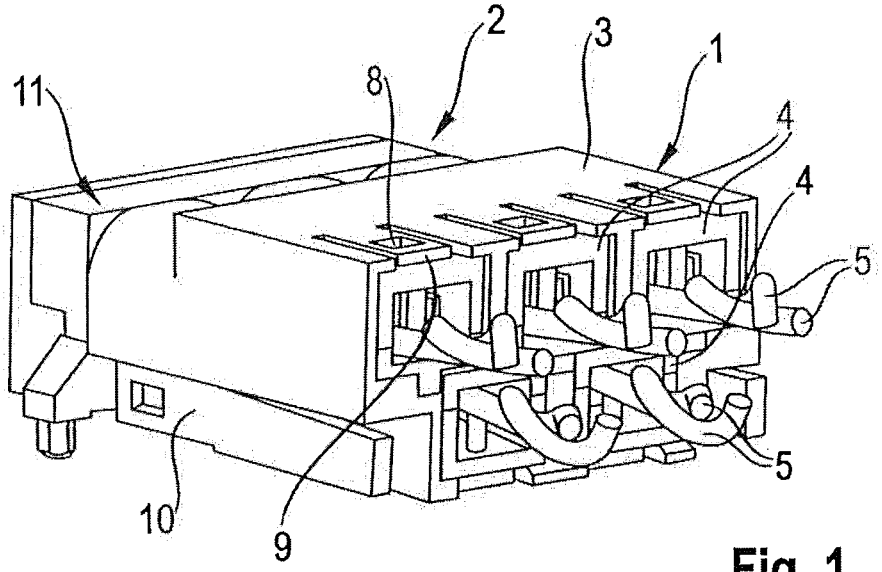
FIG. 1 is a first perspective view of an insertion-type connection having an insertion-type printed circuit board connector and a multiple insertion-type connector.

In describing the preferred embodiment of the present invention, reference will be made herein to FIGS. 1-9 of the drawings in which like numerals refer to like features of the invention.

The object of the present invention is achieved by an insertion-type connector as defined in the claims. Advantageous embodiments of insertion-type connectors according to the invention form the subject matter of the claims and can be seen from the following description of the invention.

The idea on which the invention is based is to reduce the production costs of an insertion-type connector of the generic kind by an advantageous layout for the pairs of contact elements in the housing, the layout being intended to keep crosstalk between the pairs of contact elements as low as possible, to ensure as simple a geometric shape as possible for the housing, and also to make it possible for crosstalk between the pairs of contact elements to be kept low by the use of only one shielding element of as simple a design as possible.

This idea behind the invention is put into practice as a structure by an insertion-type connector having a housing and a plurality of pairs of contact elements fixed in the housing, in which at least two pairs of contact elements are arranged in adjacent positions in a (first) row and at least one pair of contact elements is arranged to be spaced aside from the (first) row at identical spacings from the (most closely adjacent) pairs of contact elements, and a shielding element is arranged between the pairs of contact elements in the (first) row on the one hand and the further pair of contact elements on the other hand (where a plurality of pairs of contact elements spaced from the (first) row are provided, they are preferably arranged in a second row spaced from the first one, in parallel, and the spacings from the most closely adjacent pairs of contact elements in the first row are substantially identical to each other).

What can be achieved by the zigzag layout according to the invention of the pairs of contact elements is that, in a preset volume of space, the spacing between all the adjacent pairs of contact elements is as large as possible. Crosstalk between the individual pairs of contact elements can already be kept relatively low by this means. This is further improved by the arranging of the shielding element (e.g. a shielding plate)

between the (first) row of pairs of contact elements and the further pair of contact elements or between the two rows of pairs of contact elements, as the case may be. The shielding element, which preferably does not surround the entire circumference of any of the pairs of contact elements (around a direction of insertion of the individual contact elements), may thus be of a geometrically simple configuration but, in conjunction with the layout according to the invention of the pairs of contact elements, is nevertheless able to produce a sufficiently good shielding effect.

The layout according to the invention of the elements intended for signal transmission may preferably be provided throughout the housing of the insertion-type connector, meaning that even conductors which are connected to the individual contact elements are preferably arranged in the relevant layout in a (first) row and spaced therefrom (possibly in a second row). These conductors may for example be conductors of cables (and in particular of twisted-pair cables) which have an electrically conductive connection to the contact elements. Similarly, what may also be incorporated in the housing are conductors which for example project out of the housing for a short distance at their free ends. An insertion-type connector of this kind is then particularly suitable for connection to a printed circuit board, with the free ends of the conductors then making contact with corresponding pads on the printed circuit board. In this case the insertion-type connector according to the invention may serve to connect to a printed circuit board a plurality of cables which are connected to contact elements complementary to the contact elements of the insertion-type connector.

Provision may also be made in this case for the conductors to follow an angled path in the housing. Provision is preferably then made for a shielding element (also) to be arranged between those portions of the conductors in the (first) row which are angled relative to the contact elements and the corresponding portion(s) of the conductor(s) (in the second row) which is/are spaced from the (first) row. The shielding element may thus be of a form matching the shielding element which is provided between the pairs of contact elements in the (first) row and the pairs of contact elements which are arranged at a spacing therefrom. The possibility also exists of the two shielding elements being formed in one piece, e.g., as an angled shielding plate.

Figure 2:
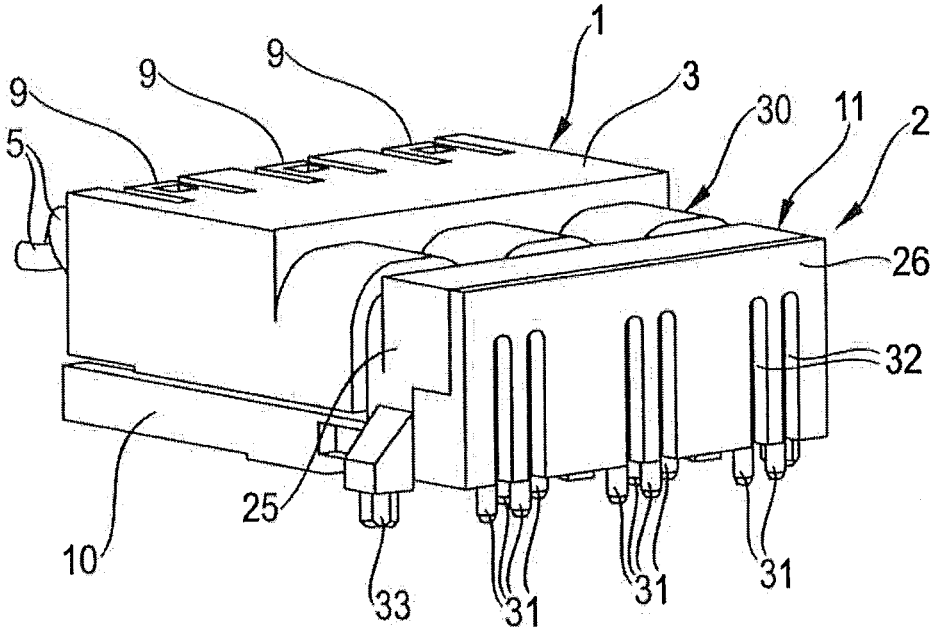
FIG. 2 is a second perspective view of the insertion-type connection shown in FIG. 1.
Figure 3:
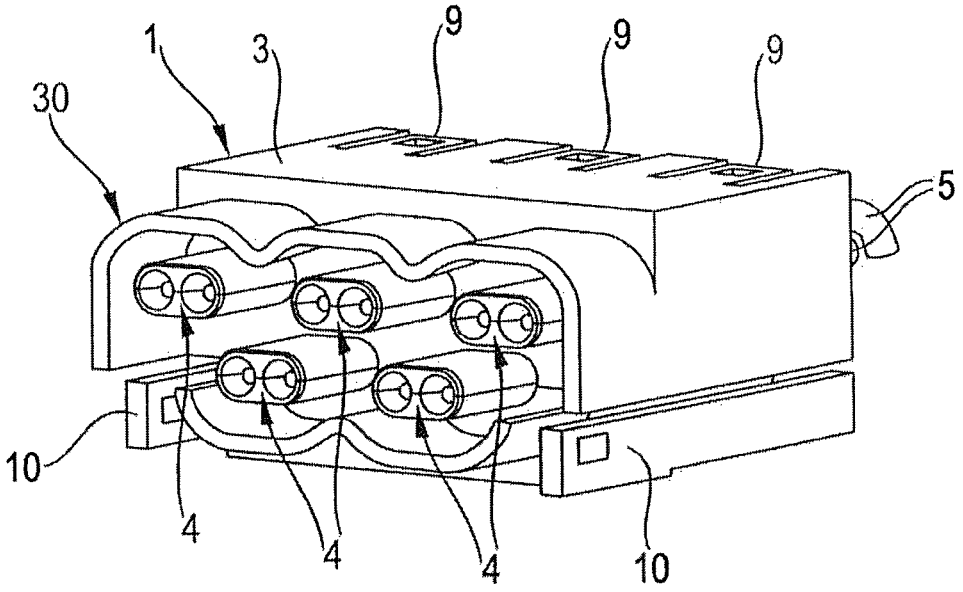
FIG. 3 is a perspective view of one embodiment of the multiple insertion-type connector of the present invention.

FIGS. 1 and 2 show an insertion-type connection comprising a (multiple) insertion-type printed circuit board connector 2 according to the invention and a multiple insertion-type connector 1 which is used with it as a mating insertion-type connector.

The multiple insertion-type connector 1 comprises a housing 3 which has a plurality (a total of five in the present embodiment) of receiving openings arranged in parallel. One insertion-type connector 4 according to the invention having a twisted-pair cable (of which only portions of the cores 5 are shown) connected to it is inserted in each of these receiving openings and is secured in position therein by a latching connection. The latching connection is formed in each case by a projection 6 which is formed on an outer side of a housing 7 of the given insertion-type connector 4, and by an undercut in the form of a through-opening 8 which is formed in a tongue for latching 9 on the housing 3 of the multiple insertion-type connector 1. As the insertion-type connectors 4 are inserted in the receiving openings, the projections 6, which slope up obliquely, deflect the tongues for latching 9 until the projections 6 engage in the through-openings 8 in the latching tongues 9. To release the latching connection, it is possible for the given tongue for latching 9 to be raised manually and thus brought out of engagement with the associated projection.

The housing 7 of the multiple insertion-type connector 1 also comprises two lateral tongues for latching 10 which are intended to make a latching connection to a housing 11 of the insertion-type printed circuit board connector 2, which has for this purpose projections 12 which slope up obliquely in the appropriate way.

Figure 4:
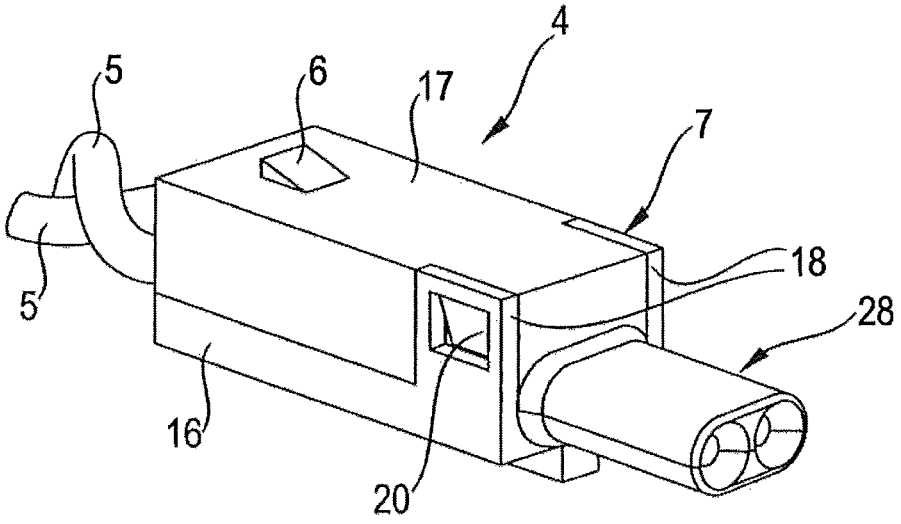
FIG. 4 is a perspective view of an individual insertion-type connector of the multiple insertion-type connector.
Figure 5:
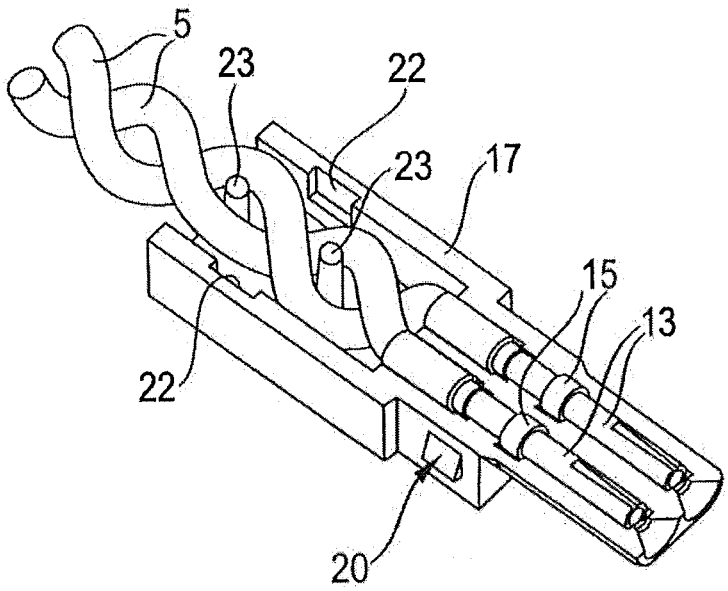
FIG. 5 is a perspective view of a part of the individual insertion-type connector shown in FIG. 4.
Figure 6:
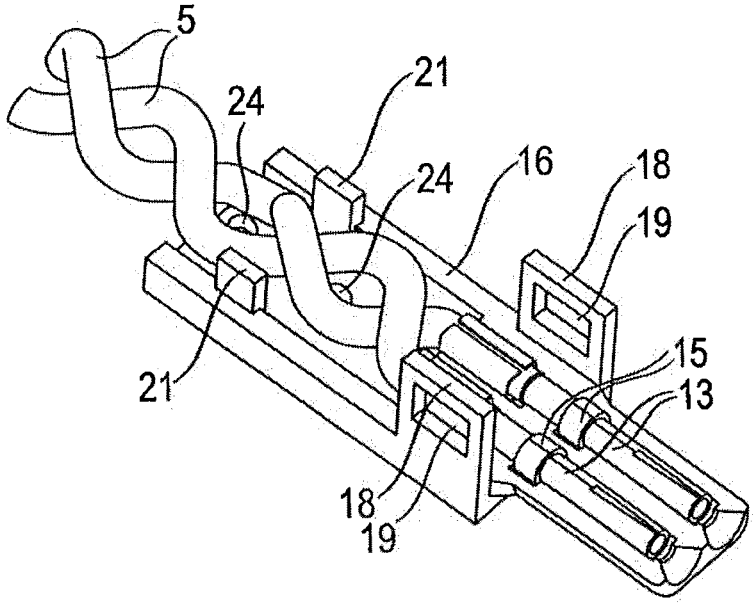
FIG. 6 is a perspective view of a part of the individual insertion-type connector shown in FIG. 4.

FIGS. 4 to 6 are views which show, in isolation, one of the insertion-type connectors 4 according to the invention together with the twisted cores 5 (electrically conductive conductors and insulating sheaths) of a twisted-pair cable which is connected thereto. As well as the housing 7, the insertion-type connector 4 also comprises two contact elements 13 which are mounted in the housing 7 in a fixed position (at least in the direction defined by their longitudinal axes) and which have insertion and cable ends. At their cable ends, the contact elements 13 are connected by crimped connections to stripped portions of respective ones of the two cores 5 of the twisted-pair cable. The insertion ends are designed to make contact with complementary contact elements 14 of the insertion-type printed circuit board connector 2, the contact elements 13 in socket form of the insertion-type connector 4 receiving contact elements 14 in pin form of the insertion-type printed circuit board connector 2 and in so doing being expanded elastically in the radial direction, which is possible due to appropriate longitudinal slots.

The fixing of the contact elements 13 in position in the housing 7 is effected by respective surrounding projections 15 which are arranged in surrounding grooves in the housing 7.

The housing 7 of the insertion-type connector 4 comprises two parts 16, 17. The plane of division between these parts 16, 17 of the housing extends in this case in parallel with, and in particular co-planar with, that plane which is defined by the longitudinal axes of the two contact elements 13. A long-lasting connection between the two parts 16, 17 of the housing is obtained by two tongues for latching 18 on a first one (16) of the parts of the housing, in whose undercuts (in the form of through-openings 19) projections 20 on the second one (17) of the part of the housing engage. There are also two projections 21 on the first part 16 of the housing which engage in complementary depressions 22 in the second part 17 of the housing and which serve to secure the two parts 16, 17 of the housing in position relative to one another.

The cores 5 of the twisted-pair cable extend along a twisted path even within the housing 7 of the insertion-type connector 4. For the cores 5, the housing 7 forms a guide which ensures that the twist is permanent and cannot come untwisted. The guidance so provided is achieved by the inner walls of a guiding space formed by the housing 7, acting in conjunction with two guiding spigots 23 which extend in the guiding space in a direction perpendicular to the plane defined by the longitudinal axes of the two contact elements and centrally between these two longitudinal axes. The guiding spigots 23 are formed in this case by the second part 17 of the housing and, for stabilization, engage in depressions 24 in the first part 16 of the housing. Continuing the twisted path along which they are guided within the twisted-pair cable, the cores 5 of the cable are guided around the guiding spigots 23 in arcs, and are thus looped partway around them. Provision may also be made in this case for at least portions of the cores 5 to be clamped in, at respective points, between the guiding spigots 23 and the inner walls of the guiding space of the housing 7 or between the inner walls of the housing 7 and whichever is the other core 5. Relatively high tensile loads can thus be transmitted by the twisted-pair cable to the housing 7. This thus provides strain relief for the crimped connections between the cores 5 and the contact elements 13.

The two parts 16, 17 of the housing of the insertion-type connector 4 are formed entirely of electrically non-conductive plastics material, with the simple geometrical shape making advantageous injection molding possible. In a demolding direction which is aligned in the direction defined by the longitudinal axes of the guiding spigots 23, only the first half 16 of the housing has undercuts, in the form of the through-openings 19 in the tongues for latching 18. However, because the tongues for latching 18 are designed to be elastically deflectable precisely because of their function, it is possible even for the first part 16 of the housing to be demolded without the use of sliders or the like.

Separate shielding is not provided for the insertion-type connector 4. However, crosstalk between the individual insertion-type connectors 34 which are combined in the multiple insertion-type connector 1 is sufficiently low for many applications due to the twist of the conductors 5, which continues as far as the contact elements 13.

Figure 7:
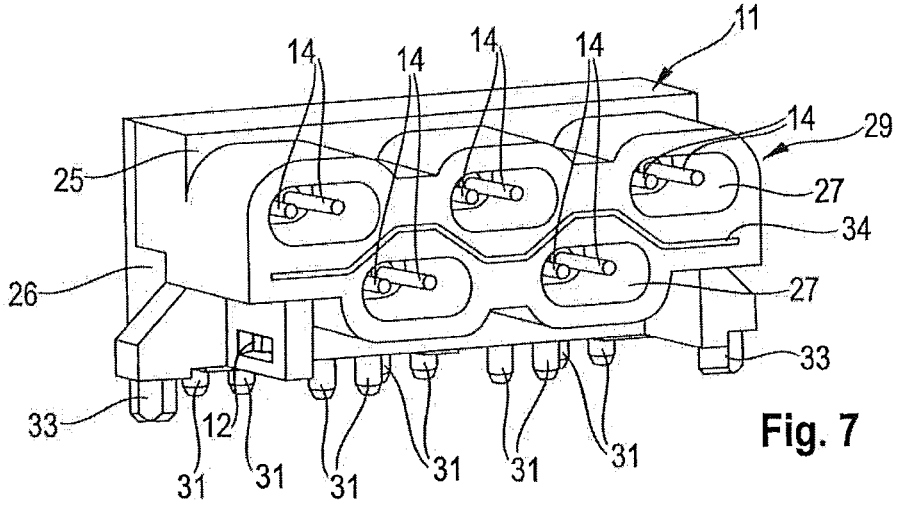
FIG. 7 is a first perspective view of the insertion-type printed circuit board connector.
Figure 8:
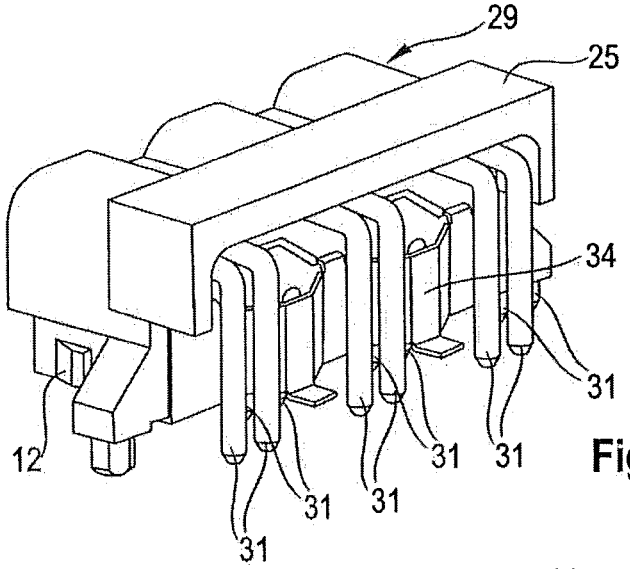
FIG. 8 is a second perspective view of the insertion-type printed circuit board connector.
Figure 9:
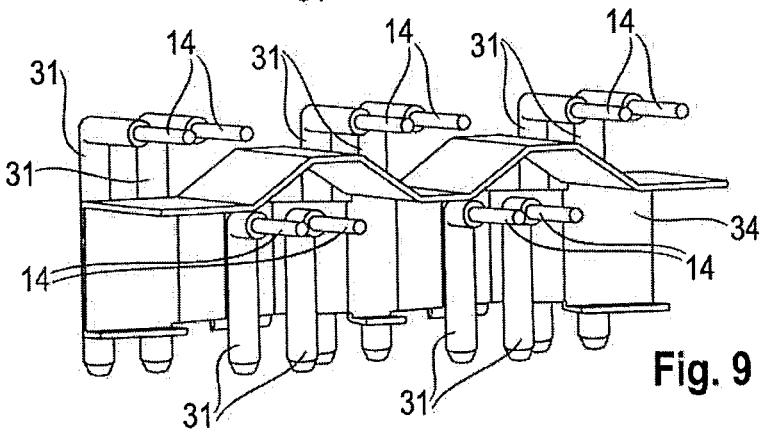
FIG. 9 is a perspective view of individual parts of the insertion-type printed circuit board connector.

FIGS. 7 to 9 are various perspective views of the insertion-type printed circuit board connector, showing it in isolation. The connector comprises the housing 11 which has a main body 25 and a cover 26. On one side, the main body 25 forms an interface for insertion which is complementary to an interface for insertion formed by the multiple insertion-type connector 1. The interface for insertion of the insertion-type printed circuit board connector 2 comprises a plurality (five in fact) of openings 27, preferably through-openings, within each of which are arranged two contact elements 14 in pin form, i.e., a pair of contact elements, aligned in parallel. These latter elements, when the insertion-type connectors 1, 2 are in the plugged-together state, make contact with the contact elements 13 of the multiple insertion-type connector 1. The cross-section of the openings 27 in the main body 25 is that of an elongated oval and corresponds to the cross-section of an insertion portion 28 of the housings 7 of the individual insertion-type connectors 4 of the multiple insertion-type connector 1. The (insertion) portion 29 of the outside of the main body 25, which (insertion) portion surrounds the openings, is of a complex shape which is complementary to the inside of an insertion portion 30 of the housing 3 of the multiple insertion-type connector 1. The insertion portions 28 of the individual insertion-type connectors 4 thus engage in the openings 27 in the main body 25 of the insertion-type printed circuit board connector 2 and the insertion portion 29 of the main body 25 of the insertion-type printed circuit board connector 2 engages in the insertion portion 30 of the housing 3 of the multiple insertion-type connector 1. In conjunction with the long-lasting fixing by the tongues for latching 10, a high mechanical load-bearing capacity can thus be obtained for the insertion-type connection.

The contact elements 14 of the insertion-type printed circuit board connector 2 are integrally formed at the insertion ends of conductors 31, which latter initially extend on for a defined distance into the main body 25 co-axially to the contact elements 14 and are then bent away through 90°. Those portions of the conductors 31 which are angled away from the contact elements 14 are received in slotted openings 32 in the cover 26, and they project beyond the cover 26 and hence the housing 11 of the insertion-type printed circuit board connector 2 in this case by a defined amount. By the projecting ends, the conductors 31 are able to make contact with corresponding pads on a printed circuit board (not shown), these ends preferably engaging at the same time in openings in the printed circuit board in order to connect the insertion-type printed circuit board connector 2 to the printed circuit board mechanically as well. Two projections 33 in spigot form which engage in corresponding openings in the printed circuit board are used to provide further mechanical stabilization.

The layout of the openings 27 and hence of the pairs of contact elements in the housing 11 of the insertion-type printed circuit board connector 2 are of a zigzag form, i.e. three of the five pairs of contact elements are arranged in a first row and the two remaining pairs of contact elements are arranged in a second row spaced from the first row in parallel therewith. Provision is made in this case for the spacings of the two pairs of contact elements in the second row from the two pairs of contact elements respectively adjacent to them in the first row to be substantially the same, thus putting the latter in central positions relative to the former. A compact layout can thus be achieved for the pairs of contact elements in the housing 11, with as large a spacing as possible from adjacent pairs of contact elements being maintained at the same time. Relatively low crosstalk between the pairs of contact elements can thus be achieved simply by virtue of the geometry.

Such crosstalk is also reduced by a shielding element in the form of a shielding plate 34 which is arranged in a slotted receptacle in the main body 25 which extends between the first row and second row of pairs of contact elements. The configuration of the receptacle, and hence of shielding plate 34, is not plane in this case but of a zigzag form, corresponding to the layout of the pairs of contact elements.

As can be seen from FIG. 9 in particular, the shielding plate 34 is also angled through 90° and thus follows the path followed by the conductors 31. At the same time, that portion of the shielding plate 34 which extends at an angle to the contact elements 14 separates the relevant portions of the conductors 31 into a first row and a second row, the conductors 31 in the first row also forming the contact elements 14 in the first row and the conductors 31 in the second row also forming the contact elements 14 in the second row. This layout in three dimensions for the portions of the conductors 31 which are angled relative to the contact elements 14 is achieved by making the conductors 31 in the first row on the one hand and in the second row on the other hand of different lengths.

The shielding plate 34 also forms contact tabs which are intended to make contact with shielding contacts on the printed circuit board.

The main body 25 and the cover 26 of the insertion-type printed circuit board connector 2 are formed entirely of electrically non-conductive plastics material, with the geometrically simple shape of the two components simplifying manufacture by injection molding. The shielding plate 34 which is angled through 90° is likewise of a geometrically simple shape which makes production as a stamped, punched or die-cut, and bent component easy and inexpensive.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An insertion-type connector including a housing and a plurality of pairs of contact elements fixed in the housing which, in the plugged-together state, make contact with the contact elements of a further insertion-type connector, wherein at least two pairs of said plurality of pairs of contact elements are arranged in adjacent positions in a row and at least one further pair of contact elements is arranged to be spaced from the row, the further pair of contact elements being at identical spacings from the two pairs of contact elements which are the most closely adjacent pairs of contact elements, wherein the contact elements of all said plurality of pairs of contact elements are connected to respective single conductors, the conductors there being laid out, in the same layout as said plurality of pairs of contact elements, at least two conductors in adjacent positions in a row, and at least one further conductor spaced from the row at identical spacings from the two conductors in the row, said conductors follow an angled path in the housing, and a shielding element being arranged between those portions of the two conductors in the row which are angled relative to said plurality of contact elements and the angled portion of the further conductor being spaced from the row, a shielding element being arranged between the two pairs of contact elements in the row on the one hand and the further pair of contact elements on the other hand.

2. An insertion-type connector including:

a housing and a plurality of pairs of contact elements fixed in the housing which, in the plugged-together state, make contact with the contact elements of a further insertion-type connector, wherein at least two pairs of said plurality of pairs of contact elements are arranged in adjacent positions in a row and at least one further pair of contact elements is arranged to be spaced from the row, the further pair of contact elements being at identical spacings from the two pairs of contact elements which are the most closely adjacent pairs of contact elements, wherein the contact elements of all said plurality of pairs of contact elements are connected to respective single conductors, the conductors there being laid out, in the same layout as said plurality of pairs of contact elements, at least two conductors in adjacent positions in a row, and at least one further conductor spaced from the row at identical spacings from the two conductors in the row, and a shielding element being arranged between the two pairs of contact elements in the row on the one hand and the further pair of contact elements on the other hand.

* * * * *